United States Patent [19]

Knapp

[11] Patent Number: 4,534,810

[45] Date of Patent: Aug. 13, 1985

[54] RED PHOSPHOROUS SMOKE PRODUCING COMPOSITION

[75] Inventor: Charles A. Knapp, Wayne, N.J.

[73] Assignee: The United States of America as represented by the Secretary of the Army, Washington, D.C.

[21] Appl. No.: 574,836

[22] Filed: Jan. 30, 1984

[51] Int. Cl.[3] ..... C06B 45/10

[52] U.S. Cl. ..... 149/19.6; 149/29; 149/31; 149/117; 102/334

[58] Field of Search ..... 149/29, 31, 19.6, 117; 102/334

[56] References Cited

U.S. PATENT DOCUMENTS

| | | | |
|---|---|---|---|
| 2,574,466 | 11/1951 | Clay et al. | 149/117 |
| 2,635,953 | 4/1953 | Silverstein et al. | 149/31 |
| 3,650,856 | 3/1972 | Artz | 149/117 |
| 3,733,223 | 5/1973 | Lohkamp | 149/19.6 |
| 4,151,233 | 4/1979 | Fry | 149/29 |
| 4,184,901 | 1/1980 | Tanner et al. | 149/117 |
| 4,238,254 | 12/1980 | Prähauser et al. | 149/29 |

*Primary Examiner*—Edward A. Miller

*Attorney, Agent, or Firm*—Anthony T. Lane; Robert P. Gibson; Edward F. Costigan

[57] ABSTRACT

A smoke-producing composition which will produce a dense smoke in about 5 seconds and continues to produce a visible cloud having a duration of about 10 minutes for military screening operations in the field. The composition has critical limits in proportions and particle size for effective and efficient use in the 81 mm mortar cartridge. The composition consists essentially of 75 to 90 parts red phosphorus of $10\pm5\mu$ in size, 10 to 20 parts sodium nitrate of $30\pm15\mu$, and 4 to 10 parts of an epoxy binder. All parts being by weight.

12 Claims, No Drawings

RED PHOSPHOROUS SMOKE PRODUCING COMPOSITION

GOVERNMENTAL INTEREST

The invention described herein may be manufactured, used and licensed by or for the Government for Governmental purposes without payment to me of any royalties thereon.

BACKGROUND OF INVENTION

1. Field of Invention

This invention relates to an improved smoke-producing composition for use by the military to produce a screening cover for field operations.

More particularly, this invention relates to a smoke-producing composition for battlefield screening whose initiation is rapid and whose smoke-cloud is effective in volume and efficient in persistence and duration as a military screen.

2. Description of Prior Art

Red phosphorus, the comparatively inert allotropic form of phosphorus, is used in burning-type munitions mainly for signaling purposes. Compositions consisting of red phosphorus are generally used as sea-markers. However, there is a need for smoke producing munitions for battlefield screening that will develop a large dense cloud quickly and which will sustain the cloud for a relatively long duration. Rapid ignition, large volume of smoke, long duration, and persistency or visibility are all required for military screening operations. None of the compositions of the art have or exhibit all of the latter requirements. The most suitable red phosphorus composition for military use takes 2.5 minutes to develop a cloud, and the cloud produced persisted for only 3.5 minutes in duration which limits its military use to signaling.

Standard compositions and those which use red phosphorus are incapable of meeting performance requirements due to their unfavorable ignition period and their fast burning rate. The requirements for military screening operations are difficult to accomplish since the smoke composition must develop a large volume of smoke rapidly, and yet continue to burn at a very slow rate for a long duration producing a persistent cloud of smoke which is visible for a relatively long period of time.

Red phosphorus compositions of the art have a burning time of 210 seconds, however a burning time of 600 seconds is required. In addition, the red phosphorus compositions known to date produce very toxic and mutagenic reaction products from their mixed compositions. The latter mainly precludes their use in screening operation. Further, the red phosphorus compositions of the art are very slow to ignite, and can be readily extinguished particularly during the early burning phase by adverse climatic conditions.

What is needed in the art is an improved smoke-producing composition which will produce a cloud relatively rapidly and yet will burn for a long period of time thereby producing a cloud which persists for a sustained duration when compared to compositions of the art.

SUMMARY OF INVENTION

It is therefore an object of this invention to provide an improved smoke-producing composition for military screening operations.

Another object is to provide an improved smoke-producing composition whose ignition is relatively rapid and whose persistent cloud is sustained for a satisfactory period or duration of time.

A further object is to provide an improved smoke-producing composition which ignites within about 5 seconds and whose smoke-cloud lasts in visibility for a period of about 10 minutes.

A further object is to provide an improved smoke-producing composition which has a self-sustaining capability and which will survive adverse climatic conditions.

Still a further object is an improved pellet having improved smoke-producing capability for military screening operations.

Still another object is a munition having an improved pyrotechnic charge with improved smoke producing capabilities.

It has been found that a phosphorus composition consisting essentially of red phosphorus, sodium nitrate, and an epoxy binder within critical limits of particle size and proportions satisfy the needs of the art for effective field applications relative military screening operations. This has been demonstrated in the XM819 81 mm mortar cartridge in dynamic performance tests. The composition for this munition consisted essentially of (a) red phosphorus having a particle size of between about 5$\mu$ and about 15$\mu$ and being present in an amount of between about 75 and about 90 parts by weight, (b) sodium nitrate having a particle size of between about 15$\mu$ to about 45$\mu$ and being present in an amount between about 10 and about 20 parts by weight, and (c) an epoxy binder between about 4 and about 10 parts by weight.

DESCRIPTION OF PREFERRED EMBODIMENT

In the preferred formulation, the red phosphorus is present in an amount of about 85 parts by weight. It could be increased to about 90 parts by weight. However, above that amount there would be limitations on the other ingredients in the composition such as the sodium nitrate and the initiation period would be adversely lengthened. When the amount of red phosphorous is reduced below about 75 parts by weight, the difference in weight is made up with fillers or oxidants and as a result the amount of smoke is reduced in overall volume. Below such a lower limit the phosphorus still may make the composition adequate for other applications but not for screening. This is because of the decreased amount of smoke.

The oxidizing agent, sodium nitrate, should be present in the composition between about 10 and 20 parts by weight. If an amount greater than about 20 parts by weight is used, it has been found that the composition is more sensitive to impact, friction, temperature, and electro-static charge and will become more hazardous to handle. If the sodium nitrate is present at a lower quantity in the composition, it is slow to ignite and the production of smoke from the red phosphorus is not as rapid as would be desired for screening operations. The preferred amount of sodium nitrate is 85 parts by weight for optimum results.

The epoxy binder of the composition is preferably present at about 7 parts by weight. It can be present in an amount between about 4 and about 10 parts by weight. However, below 4 parts by weight, the composition in the hardened state would not withstand setback of the firing operation. Also, if the binder is present in an amount above about 10 parts by weight, the binder itself would retard ignition and combustion, and there would not be a fast build-up of smoke necessary for the screening operation.

In the production of the composition, the epoxy compound is mixed with a hardener for about 2 minutes. In the present situation Epon 828 resin was mixed with Versamid 40 a hardener on an equal parts by weight basis. Epon 828 is a liquid epoxy resin condensation product of epichlorohydrin and bisphenol A having a viscosity of 100 to 160 poises and an epoxide equivalent of 180 to 195. The epoxide equivalent being the number of grams of resin containing one gram equivalent of epoxide. Versamid 40 hardener is the condensation product of dilinoleic acid and ethylene diamine. Acetone was then added to the epoxy binding mix and agitated for about 5 minutes. The ratio of acetone to binder was about 1.5 gallons to 3.5 pounds of binder. At this point, 42.5 pounds of red phosphorus was introduced to a Simpson or Lancaster mixer, to which the acetone solution containing the epoxy binder was added, and the mass was mixed for about 5 minutes. The sodium nitrate was then added to the blender and mixed for about 10 minute cycles for a total blend time of approximately 55 minutes. The resulting mass was then preferably granulated through a No. 8 sieve. It has been found that the composition should be soft and damp with acetone during the pellet consolidation procedure.

PELLET MAKING PROCEDURE

A conventional pellet-making maching from the Stokes Company was utilized in making the pyrotechnic pellets. About 43 grams of the cited soft composition was introduced into a mold, and pressed with a load of 12000 pounds per square inch with a dwell time of 10 seconds.

The solidified wedge-like pellets were then ready for use in the 81 mm smoke producing shell wherein 4 pellets make up one layer of 7 individual layers for a total of 28 pellets per shell. Each layer of 4 pellets is circular in shape having a central opening for the ignition gases from the expelling charge (black powder) in the fuze to pass through from layer to layer. The resulting charge resembles a substantially cylindrical charge having an axial opening for the ignition gases to pass through and ignite each layer. The M84 time fuze is utilized to initiate the smoke producing pellets and is found to be successful for rapid intiation of about 5 seconds.

I claim:

1. An improved smoke producing composition for military screening operations having an intiation period of about 5 seconds, and a persistent cloud lasting about 10 minutes consisting of (a) red phosphorus having a particle size of between about 5μ and about 15μ and being present in an amount of between about 75 to about 90 parts by weight, (b) sodium nitrate having a particle size of about 15μ and about 45μ and being present in an amount between about 10 and 20 parts by weight, and (c) an epoxy binder between about 4 and about 10 parts by weight.

2. The composition of claim 1 wherein the red phosphorus is present at about 85 parts by weight, the sodium nitrate is present at about 15 parts by weight, and the epoxy binder is present at about 7 parts by weight.

3. The composition of claim 1 wherein the red phosphorus having an average particle size of about 10μ, and the sodium nitrate having an average particle size of about 30μ.

4. The composition of claim 2 wherein the red phosphorus has a particle size of about 10μ, and the sodium nitrate has a particle size of about 30μ.

5. An improved smoke-producing pellet for military screening operations having an initiation period of about 5 seconds, and a persistent cloud lasting for about 10 minutes consisting of (a) red phosphorus having a particle size of between about 5μ and about 15μ and being present in an amount of between about 75 and about 90 parts by weight, (b) sodium nitrate having a particle size of between about 15μ and about 45μ and being present in an amount between about 10 and 20 parts by weight, and (c) an epoxy binder present in an amount of between about 4 and about 10 parts by weight.

6. The pellet of claim 5 wherein the red phosphorus is present at about 85 parts by weight, the sodium nitrate is present at about 15 parts by weight, and the epoxy binder is present at about 7 parts by weight.

7. The pellet of claim 5 wherein the red phosphorus has an average particle size of about 10μ, and the sodium nitrate has an average particle size of about 30μ.

8. The pellet of claim 6 wherein the red phosphorus has a particle size of about 10μ, and the sodium nitrate has a particle size of about 30μ.

9. An improved munition having a pyrotechnic charge for military screening operations having an initiation of about 5 seconds and producing a persistent cloud for about 10 minutes consisting of (a) red phosphorus having a particle size of between about 5μ and about 15μ and being present in an amount of between about 75 and about 90 parts by weight, (b) sodium nitrate having a particle size of between about 15μ and about 45μ and being present in an amount between about 10 and about 20 parts by weight, and (c) an epoxy binder between about 4 and about 10 parts by weight.

10. The munition of claim 9 wherein the red phosphorus charge is present at about 85 parts by weight, the sodium nitrate is present at about 15 parts by weight, and the epoxy binder is present at about 7 parts by weight.

11. The munition of claim 9 wherein the red phosphorus has an average particle size of about 10μ, and the sodium nitrate has an average particle size of about 30μ.

12. The munition of claim 10 wherein the red phosphorus has a particle size of about 10μ, and the sodium nitrate has a particle size of about 30μ.

* * * * *